US006822167B2

(12) United States Patent
Levillain et al.

(10) Patent No.: US 6,822,167 B2
(45) Date of Patent: Nov. 23, 2004

(54) MAKING A COMPOSITE INSULATOR BODY

(75) Inventors: Roger Levillain, Saint-Yorre (FR); René Joulie, Bellerive sur Allier (FR)

(73) Assignee: Sediver, Societe Europeenne d'Isolateurs en Verre et Composite, Nanterre cedex (FR)

( * ) Notice: Subject to any disclaimer, the term of this patent is extended or adjusted under 35 U.S.C. 154(b) by 0 days.

(21) Appl. No.: 10/622,312

(22) Filed: Jul. 17, 2003

(65) Prior Publication Data

US 2004/0084204 A1 May 6, 2004

(30) Foreign Application Priority Data

Jul. 18, 2002 (FR) ..... 02 09153

(51) Int. Cl.[7] ..... H01B 17/38; H01B 19/00
(52) U.S. Cl. ..... 174/179; 174/209; 29/887
(58) Field of Search ..... 174/142, 148, 174/149 R, 150, 152 R, 154, 158 R, 163 R, 167–172, 174, 176–179, 186, 195, 201, 209; 29/887

(56) References Cited

U.S. PATENT DOCUMENTS 3,261,910 A * 7/1966 Jacquier ..... 174/178
4,057,687 A * 11/1977 Willem ..... 174/179
4,373,113 A 2/1983 Winkler et al.
5,233,132 A * 8/1993 Soucille ..... 174/179
6,031,186 A * 2/2000 Sakich et al. ..... 174/179
6,065,207 A * 5/2000 Fujii et al. ..... 29/887
6,576,846 B2 * 6/2003 Portas et al. ..... 174/209

FOREIGN PATENT DOCUMENTS

EP 0 264 684 4/1988
EP 1 054 415 11/2000

* cited by examiner

*Primary Examiner*—Dean A. Reichard
*Assistant Examiner*—Adolfo Nino
(74) *Attorney, Agent, or Firm*—Ware, Fressola, Van Der Sluys & Adolphson

(57) ABSTRACT

The method of manufacturing a composite insulator constituted by a rod surrounded by an insulating coating and provided at its two ends with two metal end fittings respectively consists in the following steps:

fixing two respective metal interfaces to the two ends of the rod, the metal end fittings of the insulator subsequently being fixed to the interfaces; and putting the coating into place around the rod and around the metal interfaces while leaving an end portion of each metal interface uncovered by the coating so as to enable the metal end fittings to be fixed thereto subsequently.

8 Claims, 1 Drawing Sheet

MAKING A COMPOSITE INSULATOR BODY

CROSS-REFERENCE TO RELATED APPLICATIONS

This application claims priority under 35 USC § 119 to French Patent Application No. 0209153 filed on Jul. 18, 2002.

TECHNICAL FIELD

The invention relates to a method of making a composite insulator for medium voltage distribution, the insulator comprising a rod surrounded by an insulating coating and provided at its two ends with two metal end fittings, respectively.

BACKGROUND OF THE INVENTION

A composite insulator of this type is described, for example, in French patent application No. 2 514 546. That patent application teaches making the connection between the rod and a metal end fitting of the insulator by using a ductile tube, assembly being performed by sleeve coupling.

OBJECT AND SUMMARY OF THE INVENTION

The object of the invention is to provide a method of manufacturing such an insulator at lower cost by standardizing the manufacture of the insulator body.

The method of the invention consists in the following steps:

- fixing two respective metal interfaces (3; 13) to the two ends of the rod, the metal end fittings of the insulator subsequently being fixed to the interfaces; and
- putting the coating into place around the rod and around the metal interfaces while leaving an end portion of each metal interface uncovered by the coating so as to enable the metal end fittings to be fixed thereto subsequently.

With this method, it is possible to mass produce standard insulator bodies having the same dimensions without their end fittings, which end fittings can be put into place subsequently immediately prior to delivering the insulators to the customer or the worksite. The fact that the end fittings are not fixed to the composite insulator body while the insulating coating is being put into place means that a larger number of insulator bodies can be put into the same mold for putting the coating into place, thereby enabling economies of scale to be achieved and reducing the unit price of manufacturing an insulator.

The invention extends to the following features of the method and to an insulator made by the method:

- the coating is put into place by injection molding;
- each metal interface is fixed to an end of the rod by a swaging technique;
- each metal end fitting is fixed to a metal interface by a swaging technique with the help of a worksite press;
- each metal interface is a tube;
- the tube has an internal transverse wall providing a sealed separation between the rod and a metal end fitting;
- the internal wall is a metal web; and
- the internal wall is a separate fitting.

BRIEF DESCRIPTION OF THE DRAWING

Embodiments of a composite insulator of the invention are described below and shown in the figures.

DETAILED DESCRIPTION

Figure 1:
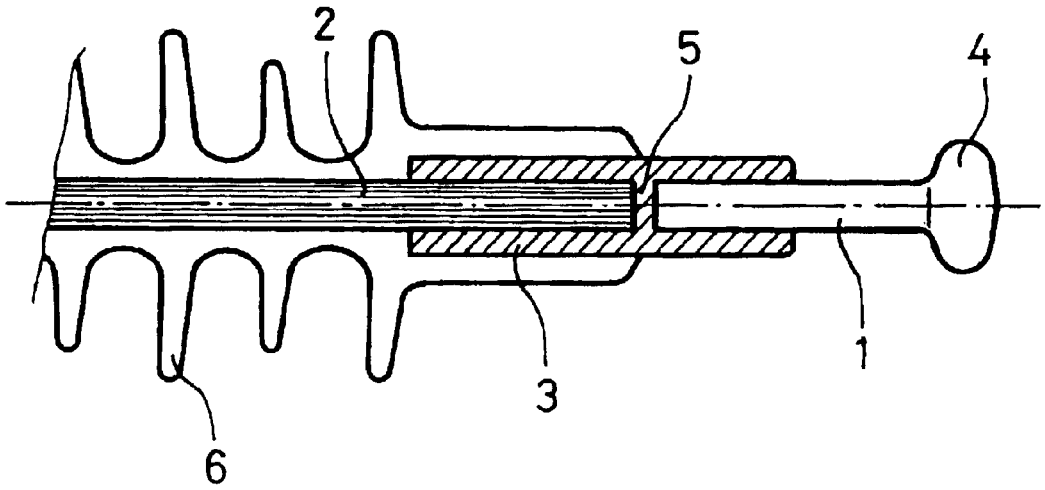
FIG. 1 shows a portion of a composite insulator provided with a metal end fitting whose outside portion is in the form of a knob, where the remaining portion of the composite insulator is essentially the same as that shown.

In FIG. 1, there can be seen a metal interface 3, in this case a ductile metal tube, which is sleeve coupled by a swaging technique to one end of the rod 2 of an insulator. The rod is made of a synthetic material, for example out of glass fibers and resin. Although not shown in FIG. 1, the second end of the rod 2 extends beyond coating 6. A second metal interface 3 is coupled to this second end of rod 2.

A coating 6 is placed around the rod 2 and around both interfaces 3, while nevertheless leaving an end portion of each interface 3 uncovered by the coating. This not covered or bared end portion of each interface can be used after the insulator body has been made for fixing an endpiece to each interface. In FIG. 1, the forged steel metal endpiece 1 is terminated by a knob 4, which endpiece is inserted into the tube 3 and is then fixed thereto by a swaging technique. In order to obtain leaktightness for the rod portion, the tube 3 includes an inside transverse separating wall 5 which may be a metal web obtained by molding or by machining, or which may be a silicone seal, e.g. fitted inside the tube. The inside diameters of the two end portions of the tube 3 may be identical or different. When the diameters are identical, it is possible to use a standard commercially-available tube, thereby further reducing the cost of manufacturing the insulator.

The metal end fitting of the insulator may be a clevis, a tenon, a ball-socket, etc., without going beyond the ambit of the invention. The fact that the insulator body is standardized without being provided with end fittings while the insulating coating is being put into place enables mass production to be performed at reduced cost, given that medium voltage distribution insulators differ from one another in general only in the particular features of their metal end fittings.

Figure 2:
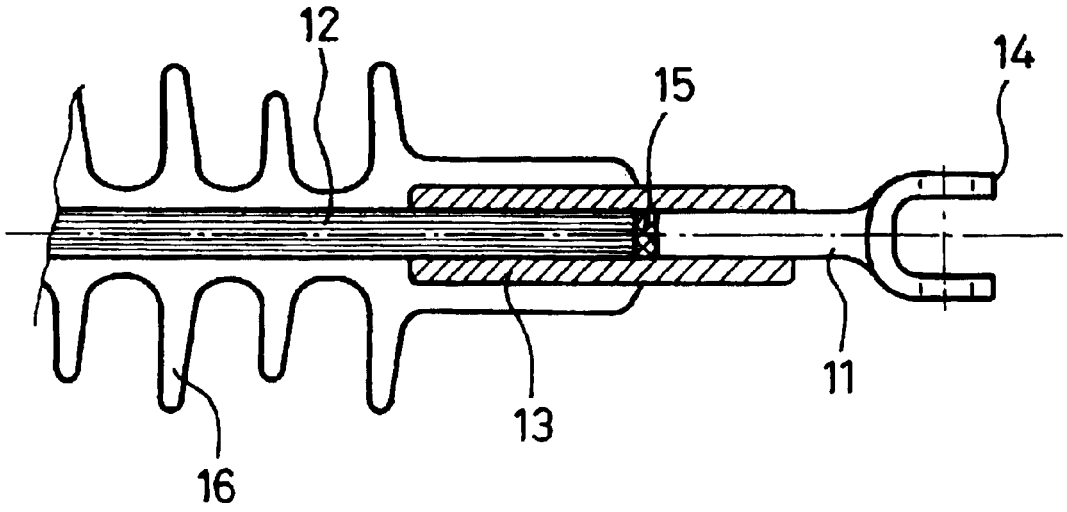
FIG. 2 shows a portion of a composite insulator provided with a metal end fitting whose outside portion is terminated by a clevis, where the remaining portion of the composite insulator is essentially the same as that shown.

FIG. 2 shows a rod 12 having a tube 13 fixed to the end thereof, the tube serving as an interface for an end fitting 11 that is terminated by a clevis 14. An insulating coating 16 surrounds the rod 12 and a portion of the tube 13. The tube has an internal wall 15 fitted thereto, in this case a silicone plug. Although not shown in FIG. 2, a second tube 13 is fixed to the other end of rod 12. Another end fitting 11 that is terminated by a second clevis 14 is secured to this second tube 13.

In order to manufacture the insulator of FIG. 1 or FIG. 2, a metal interface such as 3 or 13 is initially fitted to each end of a rod such as 2 or 12, e.g. by a swaging technique using a press. The rod is then placed in a mold that is suitable for putting an insulating coating into place around the rod and the interfaces, e.g. an elastomer, while ensuring that an end portion of each interface remains uncovered by the coating. As can be seen in the figures, the tubes 3 and 13 have respective end portions that are not covered by the coating and which extend substantially as far as the transverse wall 5, 15 thus making it possible to perform swaging on the bare portion using a worksite press, for example, for the purpose of securing the end fitting 1 or 11.

Naturally, the interface 3 or 13 could be of a shape other than that of a tube, providing its bare end portion and the metal end fitting are of complementary shapes suitable for being fixed together mutually.

What is claimed is:

1. A method of manufacturing a composite insulator constituted by a rod surrounded by an insulating coating and provided at its two ends with two metal end fittings respectively, the method consisting in the following steps:

fixing two respective metal interfaces to the two ends of the rod, the metal end fittings of the insulator subsequently being fixed to the interfaces; and putting the coating into place around the rod and around the metal interfaces while leaving an end portion of each metal interface uncovered by the coating so as to enable the metal end fittings to be fixed thereto subsequently.

2. A method according to claim 1, in which the coating is put into place by injection molding.

3. A method according to claim 1, in which each metal interface is fixed to an end of the rod by a swaging technique.

4. A method according to claim 1, in which each metal end fitting is fixed to a metal interface by a swaging technique with the help of a worksite press.

5. A composite insulator for medium voltage distribution manufactured by a method according to claim 1, in which each metal interface is a tube.

6. A composite insulator according to claim 5, in which the tube has an internal transverse wall providing a sealed separation between the rod and a metal end fitting.

7. An insulator according to claim 6, in which the internal wall is a metal web.

8. An insulator according to claim 6, in which the internal wall is a separate fitting.

* * * * *